US007229244B2

(12) United States Patent
Smith

(10) Patent No.: US 7,229,244 B2
(45) Date of Patent: Jun. 12, 2007

(54) FLUID FLOW ACTUATED DRIVE MEANS

(76) Inventor: William Vicus Smith, Dahilleslot 11A, Strand, Cape Town (ZA) 7140

( * ) Notice: Subject to any disclaimer, the term of this patent is extended or adjusted under 35 U.S.C. 154(b) by 0 days.

(21) Appl. No.: 10/535,712

(22) PCT Filed: Sep. 12, 2003

(86) PCT No.: PCT/ZA03/00134

§ 371 (c)(1),
(2), (4) Date: Feb. 21, 2006

(87) PCT Pub. No.: WO2004/025085

PCT Pub. Date: Mar. 25, 2004

(65) Prior Publication Data

US 2006/0165516 A1 Jul. 27, 2006

(30) Foreign Application Priority Data

Sep. 12, 2002 (ZA) ..... 2002/7332

(51) Int. Cl.
*F03B 11/00* (2006.01)

(52) U.S. Cl. ..... 415/92; 415/202; 415/203

(58) Field of Classification Search ..... 415/90, 415/92, 202, 203
See application file for complete search history.

(56) References Cited

U.S. PATENT DOCUMENTS

| | | | | |
|---|---|---|---|---|
| 764,756 | A * | 7/1904 | Nicola | 415/202 |
| 1,504,520 | A | 8/1924 | Seidel | |
| 3,522,703 | A * | 8/1970 | Toth | 60/39.181 |
| 3,690,784 | A | 9/1972 | Farrow | |
| 3,737,248 | A | 6/1973 | Abraham | |

FOREIGN PATENT DOCUMENTS

| | | |
|---|---|---|
| AU | 506745 | 6/1979 |
| DE | 891 165 | 7/1949 |
| DE | 2 255 075 | 5/1974 |
| EP | 0 372 135 | 6/1990 |
| FR | 1.604.701 | 1/1972 |
| JP | 59110801 | 6/1984 |

* cited by examiner

*Primary Examiner*—Edward K. Look
*Assistant Examiner*—Dwayne J White
(74) *Attorney, Agent, or Firm*—Merchant & Gould P.C.

(57) ABSTRACT

A fluid flow actuated drive means 10 includes a rotatably mounted impeller 12 which defines a set of circumferentially spaced outer chambers 14 which extend inwardly from openings 16 along a peripheral edge 18 of the impeller 12 and a set of inner chambers 20 which are arranged radially inwards the outer chambers 14, each outer chamber 14 being connected to a corresponding inner chamber 20 via a passage 22 to facilitate the forming of a Venturi between corresponding inner and outer chambers 20 and 14 respectively.

14 Claims, 5 Drawing Sheets

FIGURE I

FLUID FLOW ACTUATED DRIVE MEANS

FIELD OF THE INVENTION

This invention relates to a fluid flow actuated drive means.

BACKGROUND TO THE INVENTION

The use of fossil fuels in engines such as, for example, motor vehicle engines is well known. These engines are internal-combustion engines in which fuel is burned within the engine and the combustion products serve as the working medium. The expansion of the combustion products typically causes a piston of the engine to move, thereby driving an axle of the motor vehicle. The spent combustion products are then expelled from the engine into the atmosphere.

The spent combustion products contain many harmful substances that are damaging to humans as well as the environment. Development of fuels that produce less harmful substances upon combustion than conventional fuels has reduced the emission of harmful substances, but as fossil fuels are still the basic constituent of engine fuels, the emission of harmful substances remains unacceptably high.

The inventor therefore believes that a need exists for an engine that is capable of being run with little or no emission of harmful substances and a method of running such an engine.

SUMMARY OF THE INVENTION

According to a first aspect of the invention there is provided a fluid flow actuated drive means including:—

- a rotatably mounted impeller which defines a set of circumferentially spaced outer chambers which extend inwardly from openings along a peripheral edge of the impeller and a set of inner chambers which are arranged radially inwards the outer chambers, each outer chamber being connected to a corresponding inner chamber via a passage to facilitate the forming of a Venturi between corresponding inner and outer chambers;
- a housing which is configured to span the peripheral edge and to inhibit fluid flow out of the openings when the impeller is rotated relative to the housing;
- an inlet defined in the housing to permit a jet of gas to be directed at a desired angle relative to the openings when they are in alignment with the inlet to rotate the impeller; and
- an outlet defined in the housing to permit expulsion of the gas from the chambers when the openings pass and are in momentary alignment with the outlet to further encourage rotation of the impeller.

A second set of inner chambers may be arranged radially inwards the inner chambers, each inner chamber being connected to a corresponding second inner chamber via a passage to facilitate the forming of a Venturi between corresponding inner chambers.

The inlet may be in the form of a nozzle. The nozzle may be arranged at an angle of between 15 and 35 degrees, preferably 25 degrees, relative to a tangent of the peripheral edge.

Recesses may be defined in the housing to permit flow communication between adjacent openings.

The impeller may be generally disc-shaped. The impeller may be formed by two generally disc-shaped halves.

The drive means may include two or more impellers arranged in flow communication with each other. The impellers may be stacked one on top of each other.

The impellers may be contained in a housing which is configured to span the peripheral edges and to inhibit fluid flow out of the openings when the impellers are rotated relative to the housing.

Passages may be defined in the housing to permit expelled gas from one impeller to be introduced into another impeller.

The impeller may include a centrally mounted drive shaft to be driven by the impeller.

According to a second aspect of the invention there is provided a method of rotating a body having an axis, said method including the steps of:

- providing a flow stream of compressed gas which is off-set from the axis of the body;
- impinging a periphery of the body with compressed gas from the flow stream;
- filling at least one chamber defined in the body, with the impinging compressed gas;
- substantially closing the chamber to hold the compressed gas captive in the chamber;
- transferring momentum from the gas held captive, to the body; and
- releasing the gas held captive.

The method may include an additional step of transferring the compressed gas from one chamber to another chamber defined in the body along a flow path having a Venturi profile. Transfer of the compressed gas from one chamber to another may result in a transfer of momentum from the compressed gas to the body in each of the chambers, consecutively. Transferring the compressed gas may take place along a flow path having a Venturi profile. The transfer of compressed gas from one chamber to another may take place after a predetermined arcuate displacement of the body.

The method may include consecutive filling of chambers defined in the periphery of the body, e.g. an array of arcuately spaced chambers defined in a circumference of the body.

BRIEF DESCRIPTION OF THE DRAWINGS

The invention will now be described, by way of example, with reference to the accompanying diagrammatic drawings.

In the drawings:—

DETAILED DESCRIPTION OF THE INVENTION

Figure 1:
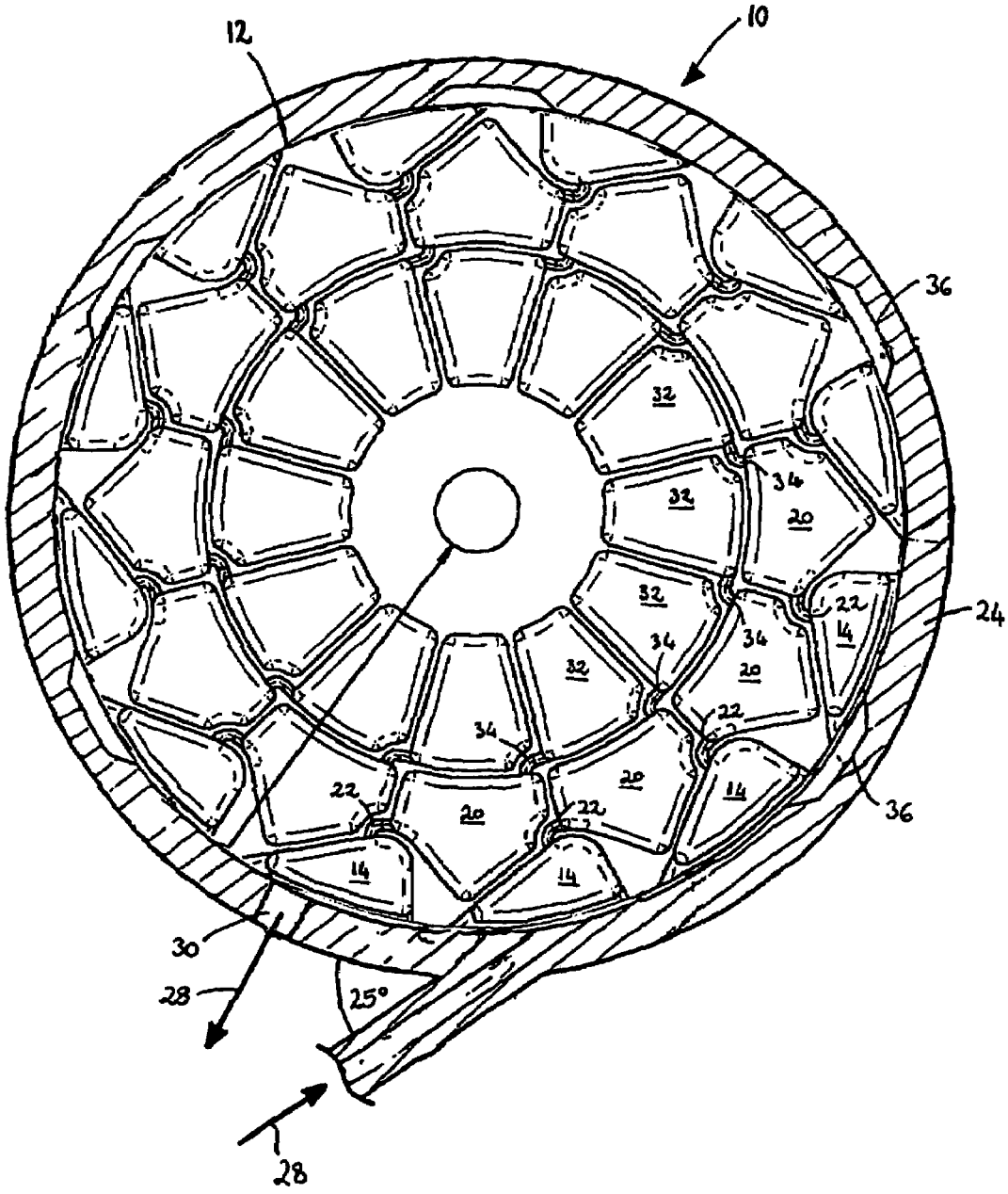
FIG. 1 shows a sectional axial view of a fluid flow actuated drive means in accordance with the invention.

In the drawings, a fluid flow actuated drive means in accordance with the invention is generally indicated by reference numeral 10.

A fluid flow actuated drive means 10 includes a rotatably mounted impeller 12 which defines a set of circumferentially spaced outer chambers 14 which extend inwardly from openings 16 along a peripheral edge 18 of the impeller 12 and a set of inner chambers 20 which are arranged radially inwards the outer chambers 14, each outer chamber 14 being connected to a corresponding inner chamber 20 via a passage 22 to facilitate the forming of a Venturi between corresponding inner and outer chambers 20 and 14 respectively.

A housing 24 is configured to span the peripheral edge 18 and to inhibit fluid flow out of the openings 16 when the impeller 12 is rotated relative to the housing 24.

The housing 24 includes an inlet 26 defined therein to permit a jet of gas 28 to be directed at a desired angle relative to the openings 16 when they are in alignment with the inlet 26 to rotate the impeller 12.

The housing 24 furthermore includes an outlet 30 to permit expulsion of the gas 28 from the chambers 14 when the openings 16 pass and are in momentary alignment with the outlet 30 to further encourage rotation of the impeller 12.

In the embodiment shown, the impeller 12 includes s second set of inner chambers 32 arranged radially inwards the inner chambers 20, each inner chamber 20 being connected to a corresponding second inner chamber 32 via a passage 34 to facilitate the forming of a Venturi between corresponding inner chambers 20 and 32.

The inlet 26 is in the form of a nozzle arranged at an angle of 25 degrees relative to a tangent of the peripheral edge 18 as shown in FIG. 1.

Recesses 36 are defined in the housing 24 to permit flow communication between adjacent openings 16.

Figure 2:
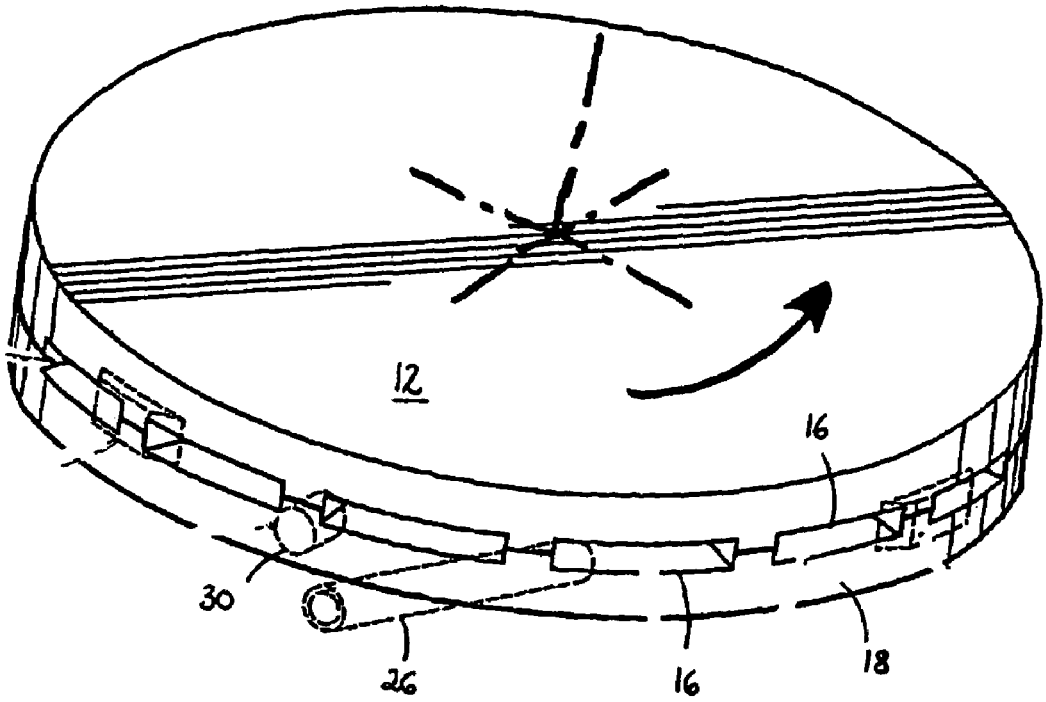
FIG. 2 shows a three-dimensional view of an impeller of the drive means of FIG. 1.
Figure 3:
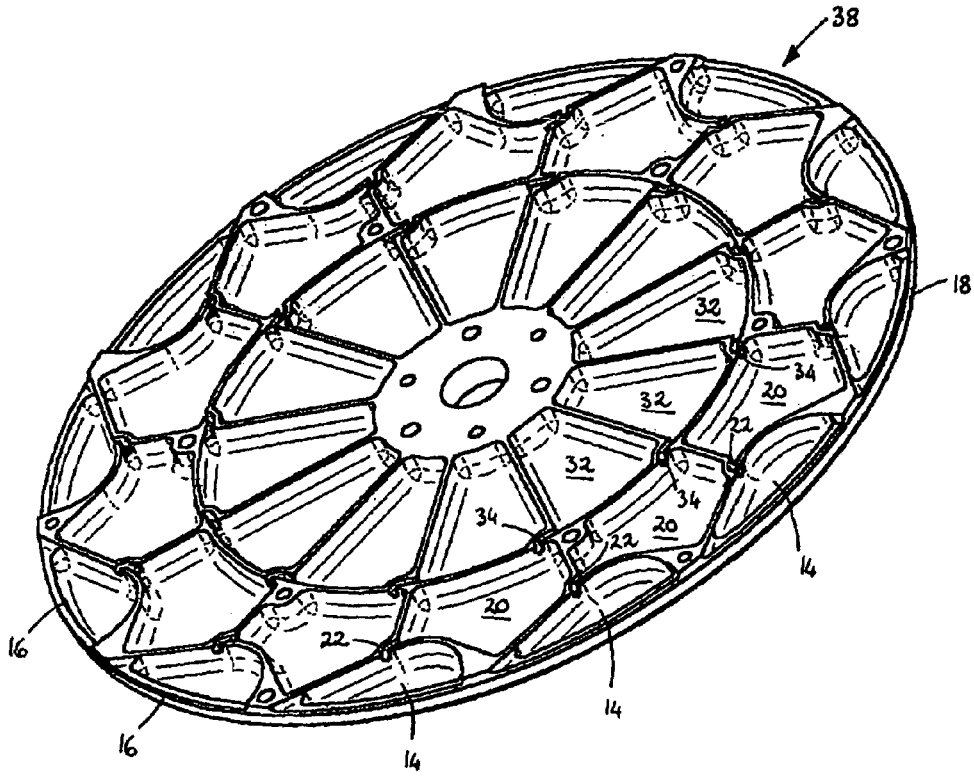
FIG. 3 shows an isometric view of one half of the impeller of FIG. 2.

As can be seen in FIG. 2, the impeller 12 is generally disc-shaped. The impeller 12 is typically formed by two generally disc-shaped halves 38 one of which is shown in FIG. 3.

The impeller 12 is manufactured from a light weight material, e.g. aluminium.

Figure 4:
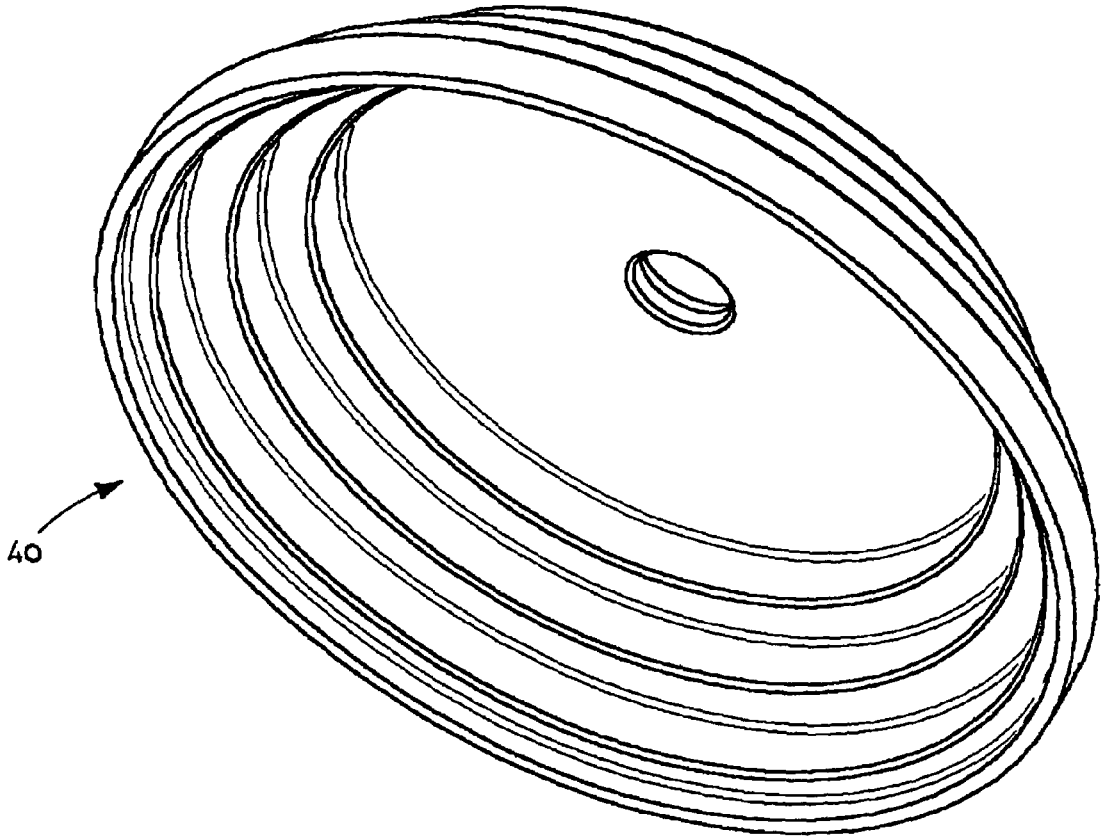
FIG. 4 shows an isometric view of a housing.
Figure 5:
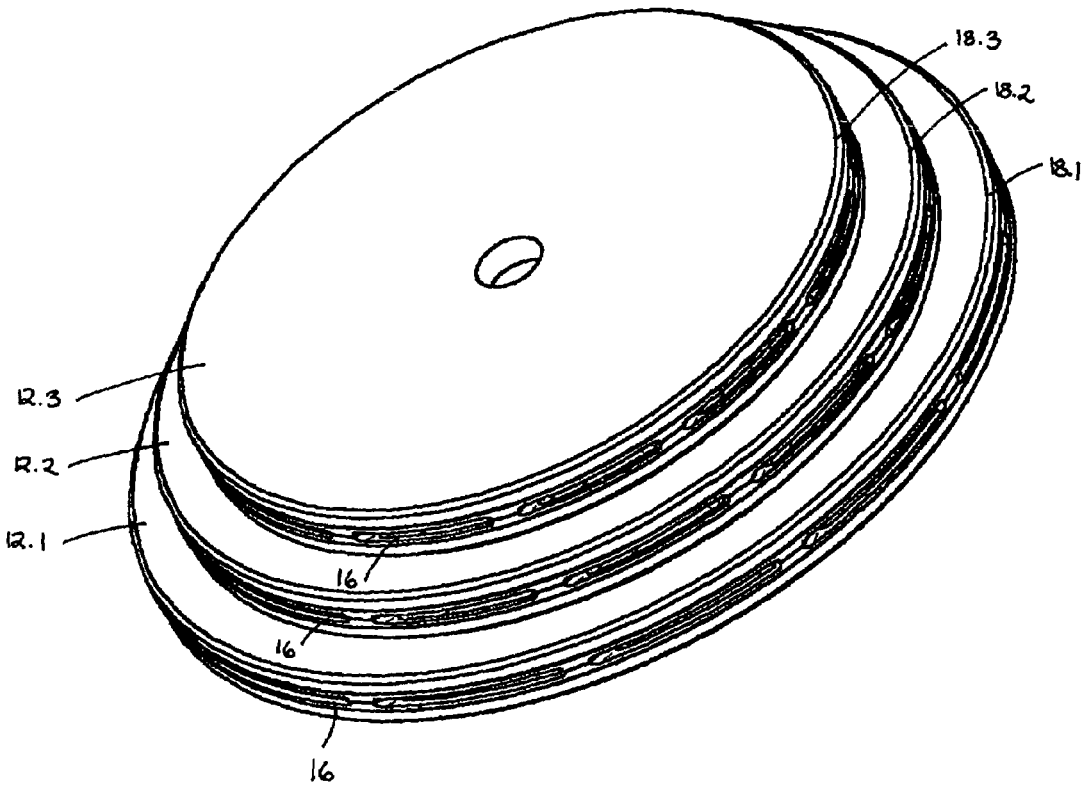
FIG. 5 shows an isometric view of three impellers as shown in FIG. 2 having consecutively smaller diameters stacked one on top of each other combined into one and which are receivable in the housing of FIG. 4.

Referring now to FIGS. 4 and 5, the drive means 10 shown includes three impellers 12.1, 12.2 and 12.3 arranged in flow communication with each other. The impellers 12.1, 12.2 and 12.3 are stacked one on top of each other.

The impellers 12.1, 12.2 and 12.3 are contained in a housing 40 which is configured to span the peripheral edges 18.1, 18.2 and 18.3 and to inhibit fluid flow out of the openings 16 when the impellers 12.1, 12.2 and 12.3 are rotated relative to the housing 40.

Passages (not shown) are defined in the housing 40 to permit expelled gas from one impeller, e.g. 12.1 to be introduced into another impeller, e.g. 12.2.

In use, the compressed gas 28 is supplied to the drive means 10 via the nozzle 26. The compressed gas 28 flows through an opening 16 into a chamber 14 of the outer row, through a passage 22 to a chamber 20 in the inner row, and through a passage 34 into a chamber 32 of the further row. Linear momentum of the compressed gas 28 flowing in the nozzle 26 is thereby transferred to the impeller 12, causing the impeller 12 to rotate.

Rotation of the impeller 12 causes the opening 16 associated with the chamber 14 which has been filled with compressed gas 28 to move arcuately in the direction from a position where the opening 16 is in flow communication with the nozzle 26, to a position where it is in close proximity of about 0.01 mm, with the housing 24, substantially closing the opening 16.

Further rotation of the impeller 12 causes the opening 16 of the chamber 14 to come into flow communication with the opening of an adjacent chamber 14, via recess 36, allowing compressed gas 28 to pass from one chamber 14 to an adjacent chamber 14. Continued rotation of the impeller 12 causes each of the openings 16 to be momentarily aligned with the outlet, allowing compressed gas 28 in the chamber 14 to flow out of the drive means 10 via the outlet 30.

It is to be appreciated, that the invention is not limited to any specific embodiment or configuration as hereinbefore generally described or illustrated.

The invention claimed is:

1. A fluid flow actuated drive means including:

a rotatably mounted impeller which defines a set of circumferentially spaced outer chambers which extend inwardly from openings along a peripheral edge of the impeller and a set of inner chambers which are arranged radially inwards the outer chambers, each outer chamber being connected to a corresponding inner chamber via a passage to facilitate the forming of a Venturi between corresponding inner and outer chambers;

a housing which is configured to span the peripheral edge and to inhibit fluid flow out of the openings when the impeller is rotated relative to the housing;

an inlet defined in the housing to permit a jet of gas to be directed at a desired angle relative to the openings when they are in alignment with the inlet to rotate the impeller; and an outlet defined in the housing to permit expulsion of the gas from the chambers when the openings pass and are in momentary alignment with the outlet to further encourage rotation of the impeller.

2. A drive means as claimed in claim 1, wherein a second set of inner chambers is arranged radially inwards the inner chambers, each inner chamber being connected to a corresponding second inner chamber via a passage to facilitate the forming of a Venturi between corresponding inner chambers.

3. A drive means as claimed in claim 1, wherein the inlet is in the form of a nozzle.

4. A drive means as claimed in claim 3, wherein the nozzle is arranged at an angle of between 15 and 35 degrees relative to a tangent of the peripheral edge.

5. A drive means as claimed in claim 1, wherein recesses are defined in the housing to permit flow communication between adjacent openings.

6. A drive means as claimed in claim 1, wherein the impeller is generally disc-shaped.

7. A drive means as claimed in claim 1, wherein the impeller is formed by two generally disc-shaped halves.

8. A drive means as claimed in claim 1, wherein the drive means includes two or more impellers arranged in flow communication with each other.

9. A drive means as claimed in claim 8, wherein the impellers are stacked one on top of each other.

10. A drive means as claimed in claim 9, wherein the impellers are contained in a housing which is configured to span the peripheral edges and to inhibit fluid flow out of the openings when the impellers are rotated relative to the housing.

11. A drive means as claimed in claim 10, wherein passages are defined in the housing to permit expelled gas from one impeller to be introduced into another impeller.

12. A drive means as claimed in claim 1, wherein the impeller includes a centrally mounted drive shaft to be driven by the impeller.

13. A method of rotating a body having an axis by the steps of: providing a flow stream of compressed gas which is off-set from the axis of the body, impinging a periphery of the body with compressed gas from the flow stream, filling at least one chamber defined in the body with the impinging compressed gas, substantially closing the chamber to hold the compressed gas captive in the chamber, transferring momentum from the gas held captive to the body, and releasing the gas held captive wherein the method includes transferring the compressed gas from one chamber to another chamber defined in the body along a flow path having a Venturi profile.

14. A method as claimed in claim 13, wherein the method includes consecutive filling of an array of arcuately spaced chambers defined in a circumference of the body.

* * * * *